United States Patent [19]

LeCocq

[11] 3,955,356

[45] May 11, 1976

[54] WATCH HAVING POSITIONED CONTROLLED DISPLAY ACTUATOR

[75] Inventor: Andrew D. LeCocq, Dallas, Tex.

[73] Assignee: Texas Instruments Incorporated, Dallas, Tex.

[22] Filed: Mar. 19, 1974

[21] Appl. No.: 452,500

[52] U.S. Cl. ..... 58/50 R; 58/23 BA; 200/52 R; 200/61.45 R; 200/61.52; 200/DIG. 29

[51] Int. Cl.[2] ..... G04B 19/34; H01H 35/02

[58] Field of Search ..... 200/DIG. 2, DIG. 18, 200/DIG. 29, 153 A, 153 N, 61.83, 52 R, 61.45, 61.52 D; 58/23 R, 23 BA, 50 R; 240/6.43

[56] References Cited

UNITED STATES PATENTS

| | | | |
|---|---|---|---|
| 2,997,557 | 8/1961 | Gillmor et al. | 200/61.52 X |
| 3,161,737 | 12/1964 | Hall | 200/153 A |
| 3,508,044 | 4/1970 | Hochberg | 58/50 R |
| 3,729,923 | 5/1973 | Brigliano et al. | 58/50 R |
| 3,742,699 | 7/1973 | Bergey | 58/23 R |
| 3,748,847 | 7/1973 | Kouchi | 58/50 R |
| 3,812,308 | 5/1974 | Bell et al. | 200/61.52 X |
| 3,855,784 | 12/1974 | Foellner | 58/50 R |

FOREIGN PATENTS OR APPLICATIONS

| | | | |
|---|---|---|---|
| 120,324 | 9/1945 | Australia | 200/61.52 |
| 648,661 | 12/1928 | France | 200/61.52 |

*Primary Examiner*—Ulysses Weldon
*Attorney, Agent, or Firm*—Harold Levine; Edward J. Connors, Jr.; Stephen S. Sadacca

[57] ABSTRACT

Disclosed is a solid state watch having an electro optical display which is selectively actuated by a gravity switch contained in the watch casing and positioned such that upon a displacement from a horizontal of the watch the display is actuated. A preferred embodiment utilizes a triangular-shaped cavity having a ball-shaped conductor movably contained therein for engaging a pair of electrical contacts within the cavity for coupling power to the display. Furthermore, the displacement of the watch from horizontal must also be within a selected orientation range.

11 Claims, 15 Drawing Figures

Figure 1:
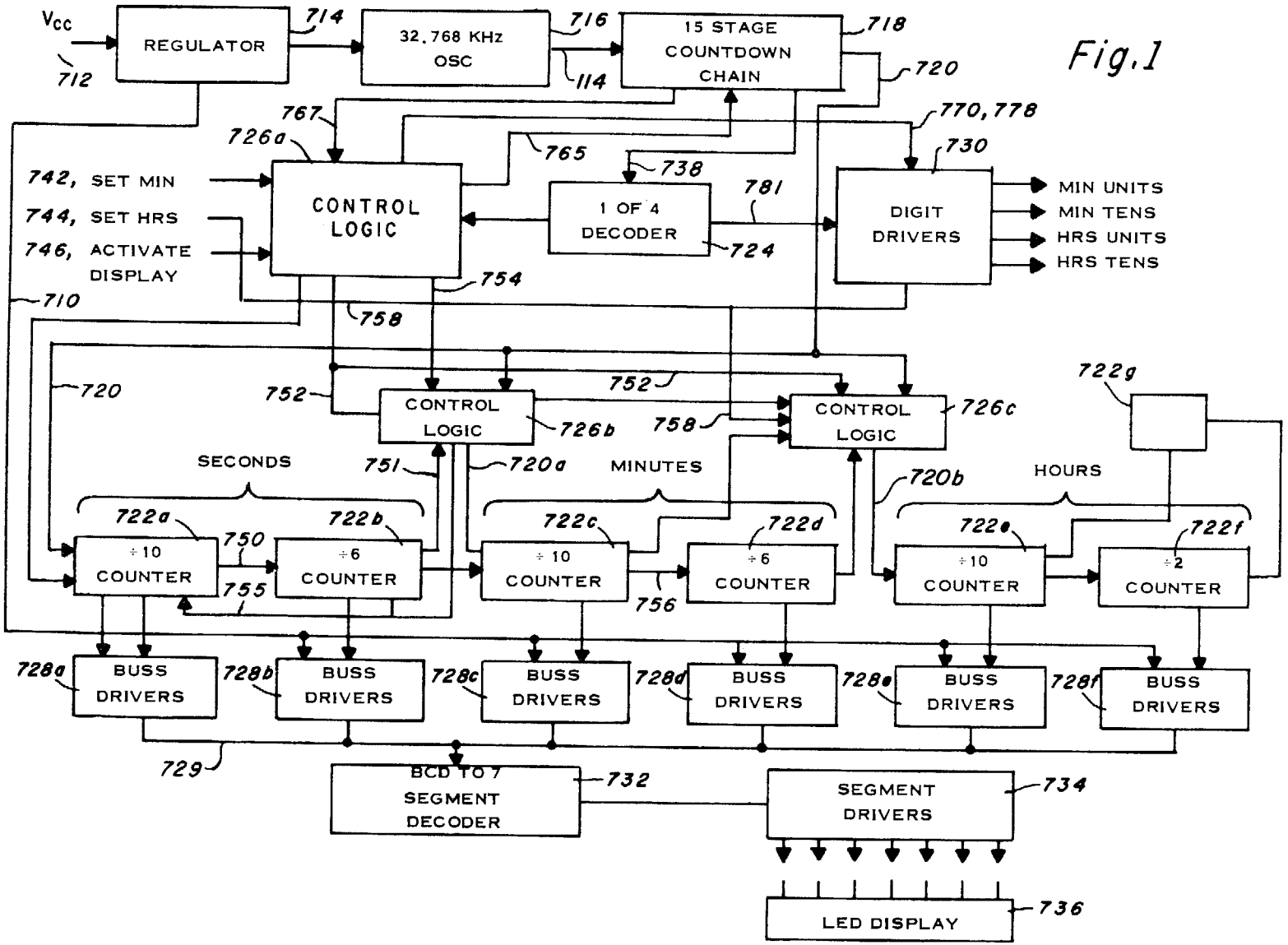

MIN UNITS
MIN TENS
HRS UNITS
HRS TENS
DIGIT DRIVERS
15 STAGE COUNTDOWN CHAIN
32.768 KHz OSC
REGULATOR
1 OF 4 DECODER
CONTROL LOGIC
CONTROL LOGIC
CONTROL LOGIC
÷2 COUNTER
÷10 COUNTER
÷6 COUNTER
÷10 COUNTER
÷6 COUNTER
÷10 COUNTER
HOURS
MINUTES
SECONDS
BUSS DRIVERS
SEGMENT DRIVERS
LED DISPLAY
BCD TO 7 SEGMENT DECODER
742, SET MIN
744, SET HRS
746, ACTIVATE DISPLAY
Vcc
712
714
716
114
718
720
770, 778
730
781
724
738
765
767
726a
754
758
752
726b
720a
751
726c
720b
722g
722f
722e
722d
722c
722b
722a
750
755
756
728f
728e
728d
728c
728b
728a
729
732
734
736
710

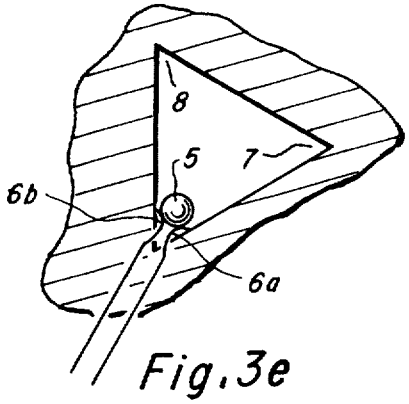
Fig. 3e
Fig. 3f
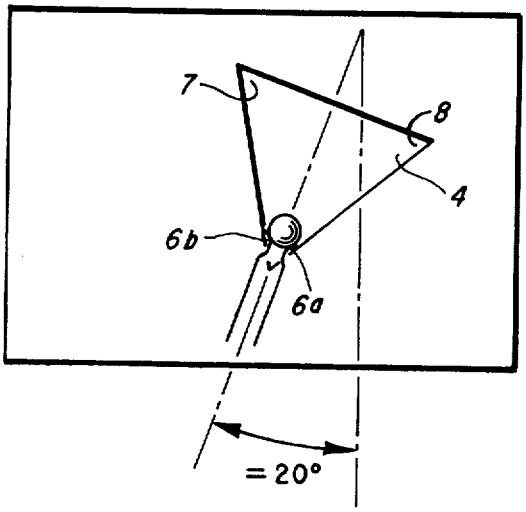
Fig. 3g
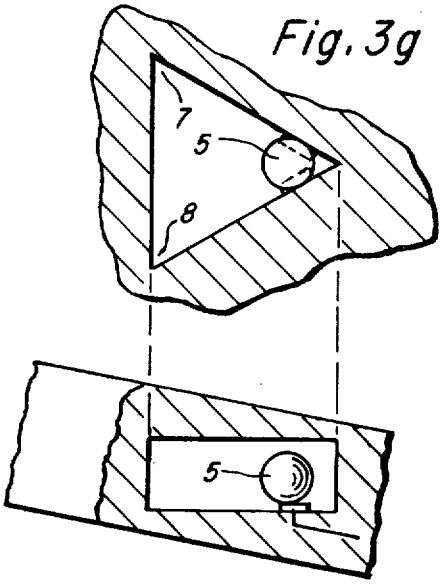
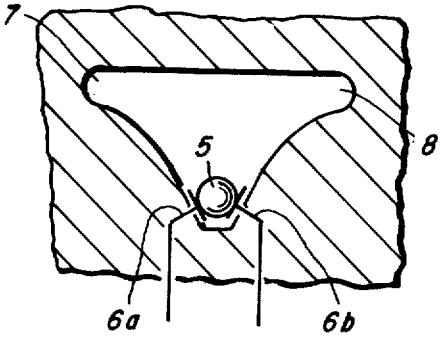
Fig. 4a
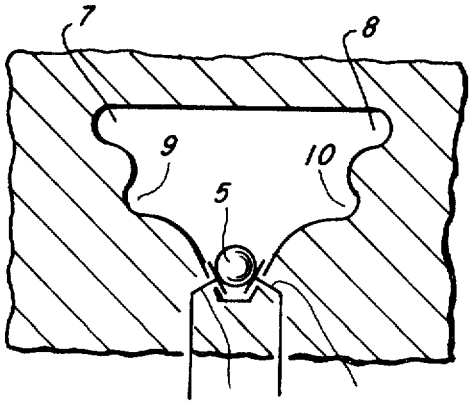
Fig. 4b TO AD CLOCK INPUT ON CHIP
FF2
FF1
÷2
÷2⁶
FROM CHIP 256 Hz
8Hz FROM CHIP

WATCH HAVING POSITIONED CONTROLLED DISPLAY ACTUATOR

This invention relates to wristwatches in general and more specifically to wristwatches having gravity display actuated switches responsive to watch positions and orientations.

Reference is directed to copending patent application entitled "Watch Having Position Controlled Display Actuator With Delay", Ser. No. 452,762 filed concurrently herewith and assigned to the assignee of this invention.

Electronic solid state watches are now well known. See, for example, U.S. Pat. No. 3,672,155, which is exemplary of a watch system having a high frequency oscillator circuit coupled to a countdown chain which provides inputs into minutes, seconds and hours counters. Electrical optical displays, such as those employing visual light emitting diode (VLED) and liquid crystals, as well as analog-type displays are coupled to such solid state watches for time display. When utilizing a VLED type display in a solid state watch, it is well recognized that power saving techniques must be utilized in combination with the VLED display if the relatively limited life battery in the watch system is to be adequate. Consequently, it is well known that such solid state watches having VLED displays and other high power consuming displays now actuate the watch only for the period of time that time reading is actually desired by the wearer. Similarly, multiplexing of the scanning of the digits such that only one digit at any time is illuminated is now commonly incorporated into watch designs. Yet further, digit sharing in time sequence for the sequential display of different time information is now commonly practiced in the art. For example, a four digit display typically initially displays units and tens digits of the hours and minutes, and then upon continued display actuation displays the units and tens digits of the seconds after extinguishing the minutes and hours information.

Display actuation switches for actuating the watch displays upon user demand have been suggested in diverse configurations. For example, it is now well known to provide a separate mechanical wearer acturable button-type switch as a demand switch. These button-type switches are conventionally of the mechanical spring load type, or of the magnetic-type. Such button-type switches, however, suffer from the inconvenience of being force actuated such as requiring depression thereof by the wearer's free hand.

Accordingly, there have been several proposals for providing a demand switch in a watch which does not require depression or actuation by the wearer's free hand. Reference, for example, U.S. Pat. No. 3,742,699, which discloses use of an inertial demand switch which actuates in response to inertia from a deliberate arm movement. Such force actuated switches, however, require either a short quick motion of the arm in opposing directions in a plane essentially horizontal to the watch face, or they require a quick upward movement of the hand or arm in a direction perpendicular to the plane of the watch. Such unnatural movements of the wearer's arm has shown to be inconvenient and occasionally discomforting to the wearer.

Another suggestion for such a display demand switch has been the use of magnetic or capacitive switches such that whenever the watch and wearer's arm is brought into close proximity with a permanent magnetic or by a change in ambient capacitance the display is actuated. Once again, these switches require unnatural movements to an external body. The external body may not conveniently be available, or such a body may inconveniently need to be carried on the person of the wearer.

Other types of such demand switches have been proposed, such as in U.S. Pat. No. 3,748,847, of such a type that actuation of the switch is accomplished by controlled pressure from that part of the wearer's arm adjacent the watch. For example, a movably attached plate which may close the electrical display circuit is responsive to a twisting of the wearer's arm such that the muscles are flexed causing the movable plate to locate against the electrical contacts. Such twisting and flexing of the wearer's wrist, however, is common in his every day activities generating unnecessary and inadvertant actuations of the display. Likewise common mercury switches in rectangular cavities are unreliable in that they generate inadvertant actuations.

It is, therefore, an object of the present invention to provide a wristwatch having a non-pressure, gravity-actuated demand switch having means for eliminating inadvertant actuations for selectively actuating the display. It is another object of the present invention to provide such a watch wherein the demand switch is positioned within the watch casing such that the display is actuated only upon a particular displacement from the horizontal.

Another object of the present invention is to provide such a watch wherein the demand switch is comprised of means having a triangular-shaped cavity with a ball-shaped electrical conductor movably contained therein. Another object of the present invention is to provide a watch with the gravity actuated demand switch in combination with a delay circuit such that the display is actuated only upon actuation of the demand switch for a predetermined period of time. It is another object of the present invention to provide such a watch having the gravity actuated demand switch in combination with de-actuation means for de-actuating the display a predetermined period of time after the display has been actuated via the gravity switch. It is still another object of the present invention is to provide such a watch having a mechanical demand switch in combination with the gravity demand switch such that the watch display may be actuated by way of the mechanical demand switch and it remains actuated only as long as the gravity switch remains actuated.

Figure 2A:
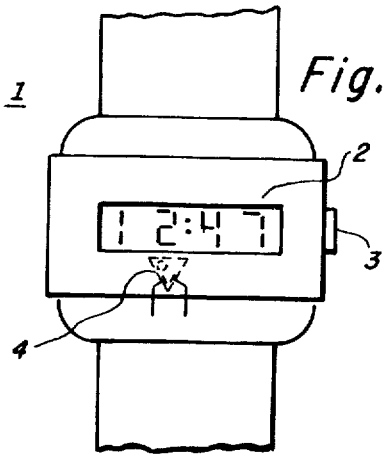
Figure 2B:
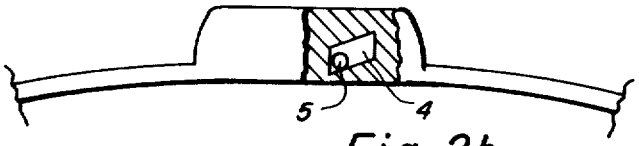
Figures 5A, 5B:
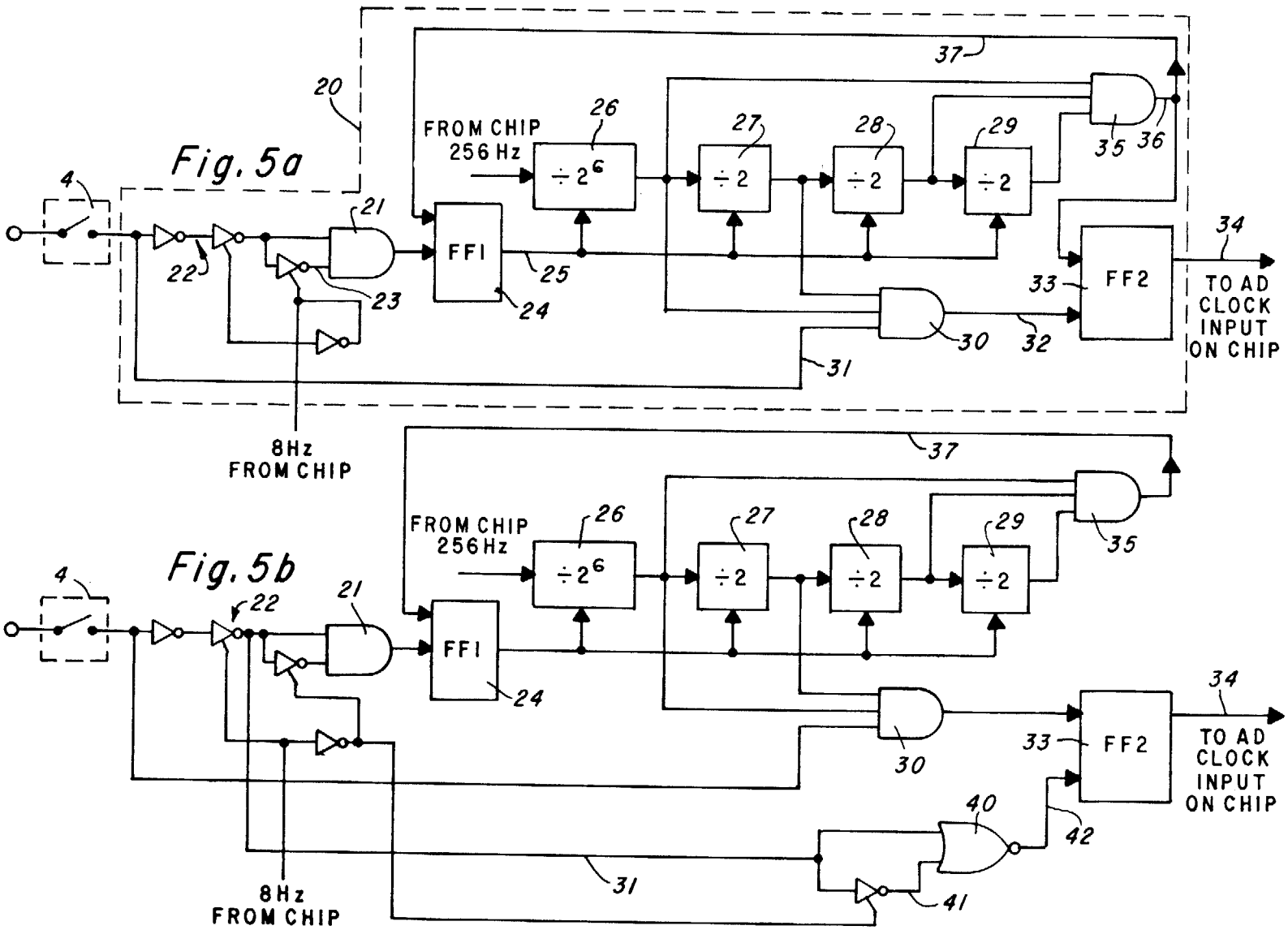
Figure 5C:
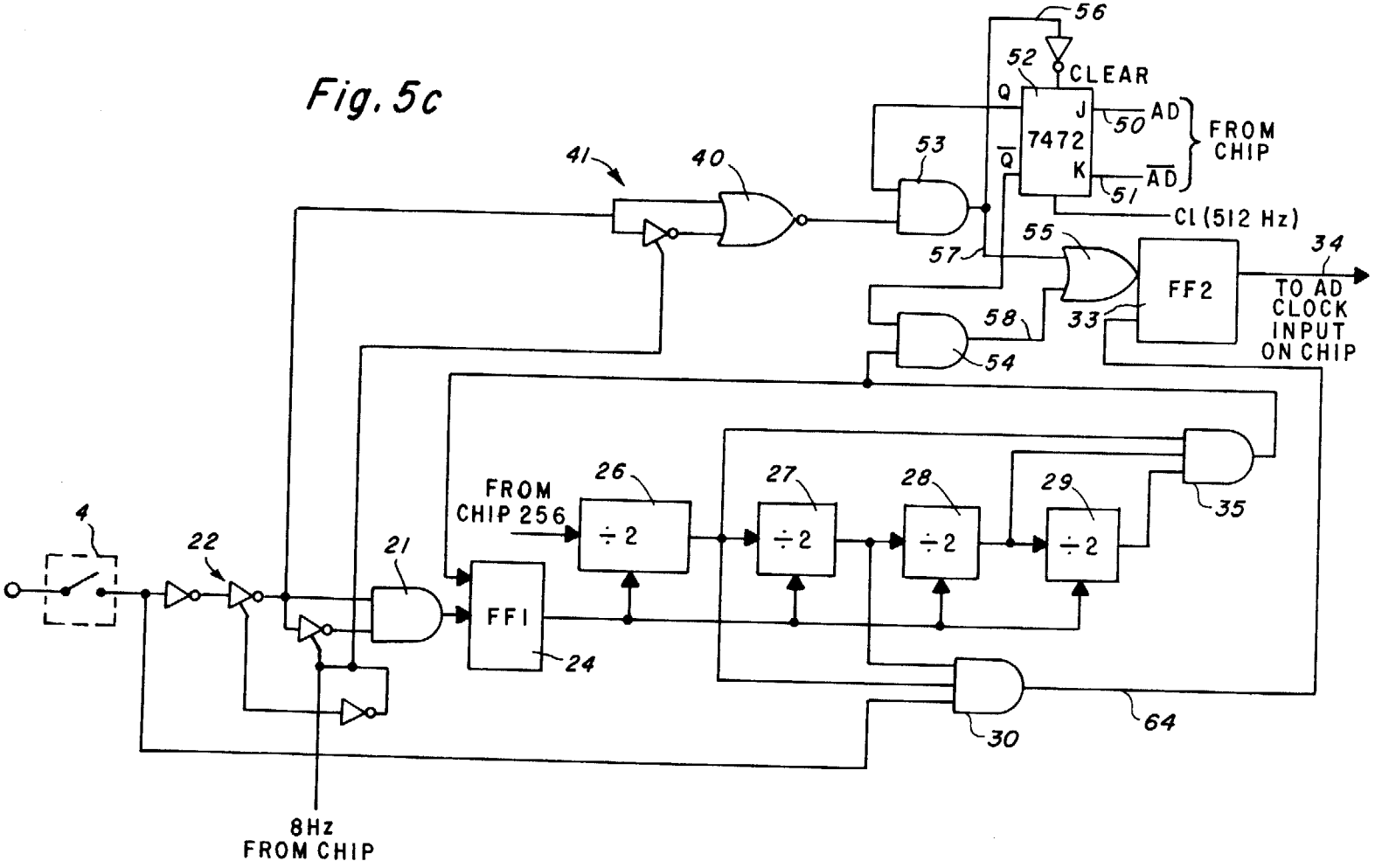

Other objects and advantages of the invention will be apparent upon reading the following detailed description of illustrative embodiments in conjunction with the drawings wherein:

FIG. 1 depicts a generalized functional blocked diagram of a watch system which may employ the gravity actuated demand switch;

FIGs. 2*a* and 2*b* show a pictorial of a wristwatch having positioned therein a gravity actuated demand switch;

FIGS. 3*a*–3*g* depict a triangular-shaped gravity switch according to one embodiment;

FIGS. 4*a* and 4*b* depict other generally triangular-shaped embodiments having irregular regions; and FIGS. 5*a*–5*c* depict electronic control circuitry which may be coupled to the gravity switch of FIGS. 3 and 4.

Referring now to the drawings in general and specifically to FIG. 1, a functional blocked diagram of a generalized watch system is set forth. Implementation of the generalized watch system is conventionally achieved using state of the art MOS, CMOS, injection logic ($I^2L$), and any other low power technologies. Batteries generate a nominal 3 volt $V_{cc}$ input 712 to a regulator 714. A crystal controlled oscillator circuit 716 generates a 32.768 K Hertz timing signal to a fifteen stage countdown chain 718. The 32.768 K Hertz master clock signal is coupled to the countdown chain 718 via coupling 114. Countdown chain 718 comprises a fifteen stage ripple counter having six successive toggle flip-flops, a two stage Johnson counter, and seven additional successive toggle flip-flops. The output of the last flip-flop in the chain 718 generates the basic 1 Hertz timekeeping signal, which is communicated via line 720 to the counters. The last three stages of chain 718 are resettable for allowing accuracy of ⅛ second when time setting the watch. By gating the 1 Hertz output signal with the 1, 2, 4, 8, and 16 Hertz countdown signals, pulse width is generated of approximately 0.03 seconds, representing a 1/32 duty cycle. As this signal is utilized as an input to the various counters, in part responsive to the setting switches coupled to terminals 742, 744 and 746 the possibility of error due to inherent bouncing of such switches 744 and 744 is minimized, as occurrence of the 0.03 second pulse and actuation of the setting switch must be coincident.

The 1 Hertz system clock is coupled to asynchronous counters 722*a*–722*f* which respectively generate the seconds (tens and units digit), minutes (tens and units digit), and hours (tens and units digit) function. Tens digit counter 722*a* is a divide by ten asynchronous counter which provides a binary coded decimal output at each of four stages to effect the units digit of the seconds display. Tens digit counter 722*b* is a divide by six asynchronous counter which is responsive via line 750 to the counter 722*a* output which generates a binary coded decimal output indicative of the tens digit of seconds. The overall combination of counters 722*a* and 722*b* comprise an asynchronous divide by sixty counter for effecting tens and units digits of seconds display.

The output of the seconds counter 722*b* is coupled to control circuit 726*b* via line 751. Control circuit 726*b* is responsive to control circuit 726*a* via line 752 and to the 1 Hertz clock via line 720 for either coupling via line 720*a* one pulse of the 1 Hertz clock under control of the seconds counter 722*b* into counter 722*c* or coupling a series of 1 Hertz signals into counter 722*c* for rapid setting of the minutes. Control circuit 726*b* is also responsive via line 754 to control circuit 726*a* for resetting via line 755 the seconds counters 722*a* and 722*b* to zero during "setting" of the watch.

The input to the tens digit minutes counters 722*c* via line 720*a* is either at the one per minute rate or one per second rate as controlled by control circuit 726*a* as above explained. Counter 722*c* is an asynchronous divide by ten counter for generating binary coded decimal outputs indicative of the ones digit of minutes. Counter 722*d* is an asynchronous divide by six counter for generating in response to counter 722*c* binary coded decimal outputs indicative of the tens digit of the minutes.

Output from counter 722*d*, 722*c* and from the control logic 726*b* and 726*a* is fed into control logic 726*c* for controlling input into the hours counters. Control 726*c* is responsive to a BCD 5 and BCD 9 code from counters 722*c* and 722*d* and to line 752 from the control circuit 726*a* for enabling an output to hours counter 722*e* each time the five-nine (59th minute) condition occurs. This out-put is logically NANDED with the output from the set hours switch 744 via line 758. Whenever the set hours switch is set via line 758, a NAND gate (not shown) of control logic 726*c* is enabled allowing the 1 Hertz signal via line 720 to be input into the hours counter 722*e*. Thus, whenever the five-nine condition has occurred a single pulse is input into the hours counter 722*e* via line 720*b* and whenever the set hours switch is activated a series of pulses at the rate of 1 Hertz is input for rapid setting of the hours counter 722*e* via line 720*b*. During the period when the hours counter is not to be incremented, the 1 Hertz signal on line 720*a* is clamped to a logic zero state.

The units digit of the hours counter 722*e* is responsive to line 720*b* for either incrementing by one each sixty minute cycle or by incrementing by one at the 1 Hertz rate. Counter 722*e* is an asynchronous divide by ten counter while state 722*f* in combination therewith provides capability of dividing by 20 for effecting tens digit read out. Feedback means 722*g*, however, causes the counters 722*e* and 722*f* to be recycled every twelve states (from one to thirteen) to provide the desired hour BCD output.

Referring now to control logic 726*a*, actuation of the activate display switch 746 causes a logic low level latch for approximately one 1½ seconds. The latch remains set regardless of any change in the condition of the activate display switch during such 1½ seconds interval. This output is communicated by line 778 for enabling the respective digit drivers 730. Thus, immediately upon actuation of the activate display switch, the minutes and hours digits of the display are activated. The reference to the activate display switch in FIG. 1 is understood to be a mechanical switch or the gravity actuated switch hereafter described, or a parallel combination of both. Several embodiments are desirously provided by combining the circuitry of FIGS. 5*a*–5*c* with the demand switch 3 of FIG. 2*a* as will hereafter be discussed. If the activate display switch has been held down during this 1¼ to 1½ second interval such that a logic zero is still applied, then the output from the seconds counter 722 is enabled for display.

Upon release of the activate display switch 746 during display of the seconds, line 770 returns to a logic one and the minutes (seconds) drivers are disabled.

Upon the activate display input, a logic one is supplied via line 765 to countdown chain 718 which resets the last three states thereof. Such enables a more accurate setting of the time, up to approximately ⅛ of a second accuracy. Furthermore, the reset signal is coupled to logic 726*b* via line 754 for resetting the seconds counter via line 755.

Upon actuation of the set minutes switch 742, a logic zero is generated for actuating the control 726*b* for enabling setting of the minutes register 722*c* at a rapid 1 Hertz rate due to line 720*a*.

Line 778 from logic 726*a* is coupled to logic gate 141 for enabling the output from the minutes and hours counters to be input to the segment decoder 732 and is further communicated to the digit drivers 730 for actuating the minutes and hours drivers.

Upon actuation of the set minutes switch 742, line 765 stops the watch by resetting the last three digits to zero of the countdown chain and resets the seconds counter to zero.

Actuation of the set hours switch 744 directly couples the hours digit drivers. Furthermore, the set hours switch is coupled to control logic 726*c* for allowing the 1 Hertz clock via line 720*b* to increment the hours counter by an appropriate number of pulses for time setting.

The one-out-of-four decoder 724, responsive to lines 738 from the countdown chain 718, generate a one-out-of-four select. A duty cycle of approximately 23% or 24% is chosen so that only one of the four outputs from the one-out-of-four decoder is actuated at any one time. Outputs 781 selectively couple the contents of the respective seconds, minutes and hours registers onto the bus lines for communication to the decoder 732, and lines 781 are coupled to the digit drivers for enabling each digit sequentially per cycle.

The bus drivers 728 drive the bus lines 729 which couple the counters to the decode matrix 732. That is, during the display minutes/hours cycle, the four digits of the minutes and hours counter are sequentially communicated on the bus lines 729 per cycle. Upon the display seconds mode, the units and tens digit from the seconds counter are serially communicated through the bus drivers onto the bus line 729.

Coupled to the bus lines for receiving the selectively transmitted information from the respective counter is a BCD seven segment decoder 732. The binary coded decimal information from the respective counters are logically decoded to drive a conventional seven segment display. The display blanks on state 15, or a BCD code of 1111 so that during the period of time when the digit drivers 730 are de-actuated, the segment drivers are also de-actuated. The output of the decoder 734 is coupled through drivers 732 to the output pins which lead to the display. Drivers 734 may be implemented using conventional multi-emitter TTL logic.

Referring now to FIGS. 2*a* and 2*b*, there is shown the top plan view and left side view of an exemplary watch having a digital display which features a gravity actuate demand switch. The watch shown generally at 1 has a digital display responsive to the timekeeping circuitry which is typically comprised of physical light-emitting diodes. However, it is understood that any display such as liquid crystals, electrochromic displays, gas discharge tube displays, and others are also suitably utilized. A mechanical externally actuated demand switch 3 is provided for selectively actuating the display 2 upon the wearer's command. A gravity actuated switch 4 preferably of a triangular configuration is provided for actuating the display 2 solely in response to positioning of the watch. That is, referring to FIG. 2*b*, a preferred embodiment depicts the gravity switch at an inclined angle of, for example 15° from the horizontal, such that the display is actuated only when the watch is tilted to an inclination of at least 15° towards the viewer. Other embodiments will be hereafter discussed wherein the gravity actuator switch 4 is combined with an externally actuated switch 3 for providing various display actuations/de-actuation alternatives.

Referring now to FIGS. 3*a*–3*g*, there are disclosed various orientations of a generally triangular-shaped gravity switch corresponding to typical arm movements. That is, it has been observed that a watch display is actuated not only when the watch is placed at a normal viewing position, but also when the arm passes inadvertently through the normal viewing position or through other positions corresponding thereto. Therefore, as will be later explained, the gravity actuated switch must be of an optimum geometrical configuration and must be judiciously oriented within the watch casing.

Figure 3A:
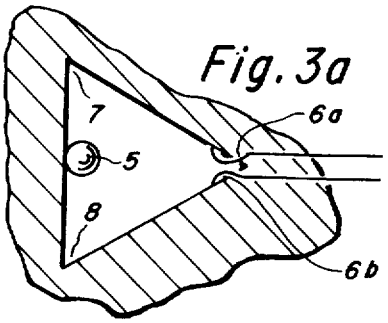
Figure 3B:
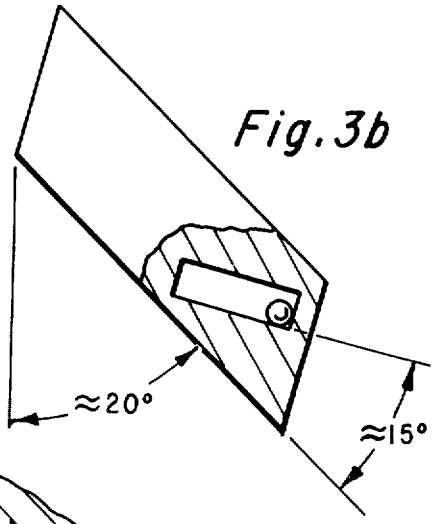

FIG. 3*a* depicts the substantially triangular gravity switch positioned at the 15° elevation as shown in FIG. 2*b* when the wearer's arm is resting on a desk. The round conductor 5 relocates to the lowest elevation of the switch and resides at either apex 7 or 8 of the triangular cavity or at a location therebetween. As desired, conductor 5 is disengaged from contacts 6*a* and 6*b* which are electrically coupled for actuating the display circuitry. In FIG. 3*b*, a sideview is shown corresponding to a man having his arm residing on a desk in front of him such that his arm is twisted to an orientation of some 20°. Since the gravity switch 4 is tilted to an approximate 15° angle within the casing, the round conductor 5 engages the contacts at the normally higher elevated apex and the display is actuated.

Figure 3C:
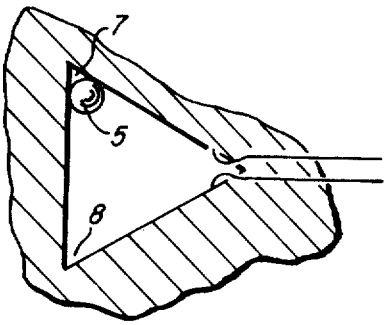
Figure 3D:
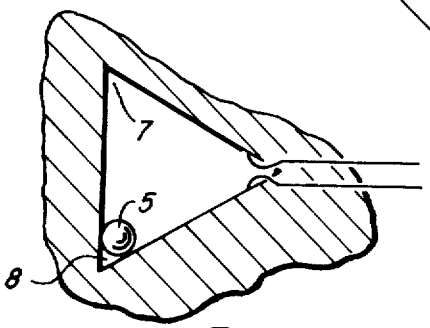

FIG. 3*c* depicts the situation where the wearer's arm is hanging to his side. The metal conductor 5 is positioned at the then lowest in elevation apex and is normally held there due to gravity and inertia from movement of the wearer's arm. Conversely, FIG. 3*d* depicts the situation where the wearer's arm is extending in the vertical direction and the conductor relocates to the then lowest in elevation apex in non-engagement with the contacts. As is realized from FIGS. 3*a*, 3*c* and 3*d*, the watch may be rotated in any and all directions in these positions in the horizontal plane indicated without actuating the display.

FIG. 3*e* depicts the situation wherein the watch is worn on the left wrist as earlier depicted, and the watch is in a viewing position. The metallic round conductor 5 is in an engaging relationship with the contacts 6*a* and 6*b* and the display is actuated. FIG. 3*e* depicts a situation wherein the wearer brings his arm into a position approximately 20° above a horizontal reference plane. That is, most watch wearers do not extend their arm when in the viewing position is parallel to a horizontal reference plane, but instead is displaced at typically 10–25 approximately 20° above such line. Accordingly, FIG. 3*f* shows an angular rotation of the triangular geometried gravity switch 4 of 10°–25° from the vertical. That is, assuming the wearer's arm lies in the direction of the arrows in FIG. 3*f*, then the switch is angularly rotated 20° from the normal to such a direction. Then, when the wearer extends his arm into the normal viewing position approximately 20° relative to a horizontal plane then the apex having contacts 6*a* and 6*b* lie at the lowest elevation possible for that specific arm actuation. That is, the side of the triangular cavity opposite from the apex having contacts located thereat in parallel with the ground plane.

FIG. 3*g* depicts yet another embodiment wherein the triangular cavity has an increased height dimension. Both contacts 6*a* and 6*b* are positioned on the lower elevation side of the cavity as shown in FIG. 3*g* such that when the conductor 5 rolls to the actuator apex in the normal viewing position, the conductor 5 then engages both contacts. However, if the watch is rotated 180° or thereabouts while the arm is still extending at the substantially 20° direction from the viewer's body, then the metal conductor 5 disengages from the contacts 6*a* and 6*b* for extinguishing the display. Such a position is encountered when the wearer extends his hands into the air and behind his head, such as when stretching. Obviously, the watch display need not then be actuated, which it achieved according to this embodiment.

Still other substantially triangular configured switches are depicted in FIGS. 4*a* and 4*b*. However, the non-contact apices 7 and 8 in FIG. 4*a* are contoured to substantially the dimensions of the conductor 5. Such a configuration tends to capture the ball 5 in the inadvertent actuation circumstances such that the conductor 5 relocates into engagement with the contacts 6*a* and 6*b* only upon a more deliberate movement. Similarly, in FIG. 4*b*, the contoured apicies 7 and 8 are complemented with dimple regions 9 and 10 in the sides adjacent the contacts 6*a* and 6*b*. Dimples 9 and 10 likewise are of a diameter substantially similar to that of the conductor 5 and tend further to capture the conductor 5 when it is traversing towards the contact apex. Such an embodiment still further tends to enable actuation only upon very deliberate arm movements. Other dimple locations, of course, may be provided in the gravity switch 4 and are understood to be within contemplation of this teaching. Likewise, antidimple structures such as projections or protuberances extending into the cavity are suitably within contemplation of this teaching.

In effect, the dimple regions referred to in FIG. 4*a* and 4*b* are delay devices which tend to delay switch actuation so that the display is actuated only upon deliberate arm movements, thereby eliminating inadvertant actuations.

Another method for eliminating inadvertent actuation when utilizing the gravity switch herein proposed is to couple electronic control circuitry in combination therewith. For example, enabling circuitry may be coupled which controls the switch actuation by enabling it only upon some overt movement, as will be discussed with respect to FIG. 5*c*, or delay circuitry is suitably coupled thereto which couples the actuated switch to the display control only after a selected period has expired and the gravity switch has remained actuated. This situation is explained with respect to FIGS. 5*a* and 5*b*.

Shown in FIG. 5*a* is the gravity switch 4 coupled to an electronic delay circuit 20. As above mentioned with respect to FIG. 1, watch chips are commercially available in integrated circuit form which accept a pulse at the activate display switch input the numeral-746 of up to 1¼ seconds and the display is actuated for the 1¼ seconds to display hours and minutes. In those watch configurations, a pulse longer than 1¼ seconds is needed before display of seconds is effected. In the embodiment of FIG. 5*a*, a delay circuit 20 is chosen such that a single pulse having width of approximately 2½ seconds is generated at the end of a selected period only if the gravity switch 4 is in the actuated position both at the beginning of the period and at the termination of the period. That is if, for example, a ¾ of one second delay is desired, then if the gravity switch 4 remains actuated for at least ¾ of a second, a single 2½ seconds pulse is emitted to the watch chip circuitry via input 746 for displaying hours and minutes for 1¼ seconds and then seconds for 1¼ seconds. If the viewer causes the gravity switch 4 to remain closed for longer than the 3¼ second period, then the display automatically de-actuates at the end of a 3¼ second cycle. Removal of edge detector 22 causes the cycle to repeat and a series of 2-½ seconds duration pulses to be supplied to the clock chip to effect a series of 1¼ displays of the hours and minutes and seconds digits. Upon de-actuation of the gravity switch 4, then the display remains de-actuated.

The electronic delay circuit 20 comprises an AND gate 21 responsive to the gravity switch 4. An intermediate frequency signal such as an 8 Hertz signal is coupled from the timing circuitry into a gated edge detector circuit 22 which actuates the AND gate 21. That is, assuming the input to the gravity switch 4 is a logic one voltage, as typically the demand switch is coupled to a battery, then upon closure of gravity switch 4 a logic one is detected by means 22 which is gated into AND gate 21 and the previous one state on line 23 causes a pulse of ⅛ Hertz to be input to flip-flop 24. Flip-flop 24 may be any bi-stable flip-flop which is responsive to a pair of inputs. Upon receiving the pulse from AND gate 21, the flip-flop outputs a set pulse on line 25 to a countdown chain comprising a $2^6$ divider and three binary dividers in series coupled thereto. The $2^6$ divider is responsive to a 256 Hertz signal from the timing circuitry, and, upon the set pulse on line 25, the divider begins counting. The output of the $2^6$ divider 26 is changing at a 4 Hertz rate, and it is input into a divide by two stage 27. Divide by two dividers 28 and 29 further divide the 256 Hertz signal down to ½ Hertz. Upon the event that the 256 Hertz signal has propagated through the $2^6$ divider 26 and the divider 27, then AND gate 30 is actuated for ¼ second provided that the gravity switch 4 has remained actuated until that time. By coupling gate 30 to the outputs of dividers 26 and 27, a delay of ¾ second is provided before an output is generated on line 32 to flip-flop 33. Flip-flop 33 is a conventional bi-stable multi-vibrator responsive to a pair of inputs and upon occasion of the pulse on input line 32, the output 34 is set. AND gate 35 is responsive to the outputs from dividers 26, 28 and 29 such that 3¼ seconds after actuation of gravity switch 4, an output is generated on line 36 from gate 35 to the AD input of the circuitry on the watch chip. As discussed earlier, a ¾ seconds delay from actuation of the demand switch 4 generates the beginning of the pulse on line 34 and 3¼ seconds after actuation of the demand switch 4, a reset to flip-flop 33 terminates the pulse on line 34. The duration of this pulse is approximately 2½ seconds which causes the minutes and hours display to be actuated for approximately 1¼ seconds, and then causes the seconds display to be actuated for 1¼ seconds.

Upon an output from gate 35 approximately 3-¼ seconds after actuation of switch 4, a reset pulse is applied to flipflop 24 via line 37 for resetting the dividers 26–29 and automatically re-initialing the system after blanking the display. Such assures that continuous actuation of the gravity switch, such as during sleep, will not dissipate the battery energy.

The above circuit is easily modified to provide a pulse less than 2½ seconds to the clock circuitry so that only minutes and hours are seen, and the seconds display remains deactuated. Such is understood to be within contemplation of this teaching.

FIG. 5*b* depicts an alternative embodiment to the delay circuit of FIG. 5*a* in that flip-flop 33 is, after being actuated by AND gate 30, de-actuated by NOR gate 40 responsive to edge detectors 22 and 41. That is, edge detector 22 is a positive going edge detector and detector 41 in combination therewith is a negative going edge detector. Operation of the circuit in FIG. 5*b* is as described with respect to FIG. 5*a* up to generation of the pulse on line 34 to the timing circuitry on the timing chip. However, at the end of 3¼ seconds, the output of AND gate 35 does not reset flip-flop 33, it only resets via line 37 flip-flop 24 for disabling the delay circuit. The pulse to the clock chip on line 34 is removed in direct response to the gravity switch 4 in that when switch 4 is de-actuated, a negative going edge is generated which is detected via the 22/41/40 combination and coupled to flip-flop 33 via line 42. Accordingly, seconds will be displayed for so long only as gravity switch 4 remains actuated. Such an embodiment effecting continuous display for so long as the gravity switch is actuated is advantageous when the wearer is, for example, a doctor desiring to take a patient's pulse, requiring continuous seconds display.

Referring now to FIG. 5*c*, a third version of a delay circuit coupled to the gravity switch 4 is depicted. The circuit of FIG. 5*c* is a hybrid circuit between FIGS. 5*a* and 5*b* in that either the circuit of FIG. 5*a* or the circuit of FIG. 5*b* controls operation of the display, as determined by a mechanical demand switch in combination with the gravity switch 4. That is, in FIG. 5*c* an AD signal and the inverted signal $\overline{AD}$ is coupled from the timing chip to the J and K inputs, respectively, of a SN 74 72 flip-flop. Upon actuation of the mechanical demand switch to input 746 in FIG. 1, a logic one appears on AD line 50 and a logic zero appears on $\overline{AD}$ line 51 and conversely, upon deactuation of the mechanical demand switch to input 746 the logic 0 appears on line 50 and a logic 1 appears on line 51; Accordingly, if prior to the expiration of the 3¼ seconds period subsequent to actuation of the gravity switch 4, the activate demand switch is actuated to input 746, then the circuit of FIG. 5*b* is coupled to flip-flop 33 from gate 30 via line 64 for the resetting thereof. Conversely, in the absence of actuation of the activate display switch 746, a logic one appears on the $\overline{Q}$ output of flip-flop 52 such that the circuit of FIG. 5*a* is coupled by means of AND gate 54 via line 58 to flip-flop 33 for the resetting thereof.

Operation of a watch having the circuit of FIG. 5*c* in combination with a demand switch 4 is as follows. Upon actuation of gravity switch 4, absent actuation from the mechanical activate display switch to input 746 a 2½ seconds pulse will be communicated via line 34 to the timing circuitry on the timing chip for 1¼ seconds display of the minutes and hours digits followed by a 1¼ seconds display of the seconds digits. However, upon actuation of the mechanical activate display switch coupled to input 746 746, then a continuous pulse is communicated to the control circuitry on the clock chip via line 34 coupled to input 746 such that seconds are displayed until gravity switch 4 is deactuated. Such a feature has application in circumstances such as a doctor desiring to monitor a patient's pulse requiring a prolonged viewing of the seconds of his watch. Obviously, the doctor would not care to have to keep the activate display switch manually depressed for the entire viewing period, so he merely taps the switch during the aforementioned 3¼ seconds period. This feature also incorporates the desirable feature of de-actuating the display after a preselected period of time even though gravity switch 4 remains actuated, accounting for the situation that the wearer of the watch wears his watch to bed where occasionally gravity switch 4 could remain actuated all night long, depleting battery life.

As earlier mentioned, the gravity switch herein described is of substantially triangular-shaped. Such shape has shown to provide an optimum geometry in reducing inadvertent actuations. A preferred embodiment of the substantially triangular-shaped cavity consists of an equilateral triangular-shaped cavity having height dimensions of approximately 0.2 inches. A substantially round conductor of approximately 0.035 inches suitably is utilized. The cavity is provided in a plastic block which has gold contacts plated onto the plastic via conventional plating processes. The round ball-shaped conductor preferably comprises a nickel core having an 18 karat gold/cobalt is typically approximately 1 milligram. With such a low weight, the the balls have proven to be commercially acceptable as such balls have proven to be of quite reliable dimensions. The weight of such a ball, however, is typically approximately 1 milligram. With such a low weight, the possibility exists that static electricity tends to occasionally cause the ball to become suspended. This problem is rendered of no concern when the inside of the cavity is coded with anti-static agent. For example, when lexan is utilized, then the commercially available Neutrostat D concentrate is a suitable anti-static compound. For most plastics, a non-rust Neutrostat is available in an aerosol can, or Armostat 900, 910 or 920 is suitable which is marketed by Armak Company in Chicago, Illinois.

It has been experimentally determined that the aforementioned 1 milligram ball weight is a minimum weight. Acceptable weights, range between 1 and 10 milligrams in that, when using gold plating and gold contacts, little change in contact resistance is encountered with variance in pressure between the gold contacts and the gold ball. Between 1 and 10 milligrams, the contact resistance for gold is relatively constant.

A typically allowable contact resistance for acceptable switching circuit electrical characteristics is: closed circuit resistance of 10,000 ohms maximum and open circuit resistance of 1.0 megohms minimum. Furthermore, a continuous cycling contact rating of 100 microamperes is typical and a single cycle contact rating of 1.0 amps maximum is typical. Such specifications are fulfilled via the gold contacts/gold plated ball above specified.

From the above description of preferred embodiments of the invention, it will be appreciated that an improved position induced display actuator switch has been described for use in a solid state digital wristwatch. The wearer is minimally inconvenienced when he desires to actuate the display, even though it is normally in an inactuated condition. Furthermore, inadvertent actuations have been minimized with the embodiments herein described.

Although preferred embodiments of the invention have been described in detail, it is understood that various changes, substitutions, alternations and other detail modifications can be made therein without departing from the spirit and scope of the invention.

What is claimed is:

1. A watch comprising:

a. a watch housing having upper and lower major surfaces parallel to a central plane;

b. an electro-optical time display selectively positioned within said housing for displaying time upon command; and c. a gravity actuated switch coupled to said display for selectively energizing said display, said switch comprising means having a cavity, electrical contact terminal means positioned at one end of said cavity, and a gravity responsive mass of electrical conductor movably contained within said cavity for making contact between said electrical contact terminal means only upon engagement therewith, said switch being positioned in said housing with said cavity displaced at a predetermined acute angle with respect to said central plane, said one end of said cavity being disposed in said housing closer to said upper major surface than the remainder of said cavity such that said switch actuates said display when the central plane of said watch housing is angularly displaced from the horizontal to at least an angle greater than said predetermined angle.

2. The watch according to claim 1 wherein said cavity is configured substantially in a triangular shape with said contact terminal means being located at one apex of said triangle providing said one end and wherein said one apex is closer to said upper major surface than the second and third apices.

3. The watch according to claim 2 wherein said mass is essentially spherical in shape having a selected raidus and wherein said second and third triangle apices are rounded having radii at least slightly larger than said selected radius for accepting said mass.

4. The watch according to claim 3 wherein the sides of said triangular cavity adjacent said first apex each have a rounded opening of radius at least slightly larger than said selected radius for temporarily capturing said mass.

5. The watch according to claim 1 wherein said mass is essentially spherical and has an electrically conductive coating.

6. The watch according to claim 5 wherein said mass comprises nickel and said coating comprises gold and cobalt.

7. The watch according to claim 1 wherein said mass is essentially spherical and is uniformly comprised of electrically conductive material.

8. The watch according to claim 6 wherein said mass is comprised of gold.

9. The watch according to claim 2 including a wrist band coupled to said casing at two points wherein said one apex is rotated between about ten and twenty-five degrees from the plane established by said points and said apex.

10. The watch according to claim 1 wherein said mass weighs between 1 and 10 milligrams.

11. The watch according to claim 3 wherein said selected radius dimension is approximately 0.0175 inches.

* * * * *